US009656464B1

(12) United States Patent
Edelen et al.

(10) Patent No.: US 9,656,464 B1
(45) Date of Patent: May 23, 2017

(54) FLUID PRINTHEAD

(71) Applicant: FUNAI ELECTRIC CO., LTD., Daito-shi, Osaka (JP)

(72) Inventors: John G. Edelen, Lexington, KY (US); Steve Bergstedt, Lexington, KY (US); Hideo Oi, Lexington, KY (US)

(73) Assignee: Funai Electric Co., Ltd., Osaka (JP)

( * ) Notice: Subject to any disclaimer, the term of this patent is extended or adjusted under 35 U.S.C. 154(b) by 0 days.

(21) Appl. No.: 14/925,738

(22) Filed: Oct. 28, 2015

(51) Int. Cl.
*B41J 2/045* (2006.01)

(52) U.S. Cl.
CPC ..... *B41J 2/04561* (2013.01); *B41J 2/0458* (2013.01); *B41J 2/04565* (2013.01)

(58) Field of Classification Search
None
See application file for complete search history.

(56) References Cited

U.S. PATENT DOCUMENTS 5,072,235 A 12/1991 Slowik et al.
6,062,668 A 5/2000 Cruz-Uribe
6,652,053 B2 11/2003 Imanaka et al.
7,350,891 B2 4/2008 Oomura et al.
8,177,318 B2 5/2012 Govyadinov et al.
8,287,082 B2 10/2012 Aoki et al.
8,376,506 B2 2/2013 Shepherd et al.
8,449,068 B2 5/2013 Govyadinov
8,870,322 B2 10/2014 Martin et al.
8,899,709 B2 12/2014 Govyadinov et al.
2002/0063745 A1 5/2002 Osborne
2007/0224087 A1* 9/2007 Ding ..... B01L 3/502792 422/83
2008/0084438 A1 4/2008 Sheahan et al.
2010/0123971 A1 5/2010 Kudo et al.
2014/0333694 A1 11/2014 Martin et al.
2015/0097894 A1* 4/2015 Masaoka ..... B41J 2/2142 347/22

FOREIGN PATENT DOCUMENTS

JP 2013082080 5/2013

* cited by examiner

*Primary Examiner* — Lisa M Solomon
(74) *Attorney, Agent, or Firm* — Amster, Rothstein & Ebenstein, LLP

(57) ABSTRACT

A fluid printhead including a plurality of heater elements that are driven to nucleate bubbles in fluid so that the fluid is ejected from the printhead in the form of drops, a plurality of drive elements, each drive element selectively driving a corresponding one of the plurality of heater elements in accordance with a printer controller, and a drop detection system that includes a plurality of drop detection cells, each drop detection cell detecting a change in electrical resistance of a corresponding one of the plurality of heater elements that occurs upon drop formation.

10 Claims, 8 Drawing Sheets

Bottle 8:

At end of 860ns pulse, increase in current due to slope change is about 300uA. This is out of the expected 29.5mA which is about a 1% change.

FLUID PRINTHEAD

FIELD

This invention is related to inkjet printheads, and in particular to systems and methods for detecting condition of an inkjet printhead nozzle.

BACKGROUND

Detecting the health of an inkjet nozzle has been a long standing problem in the field. In the case of scanning printheads, the ability to perform multiple passes has been used to minimize the impact of missing or improperly performing nozzles. As inkjet technology pushes into the laser printer performance space, printheads with nozzles spanning the entire page width have become more common. Using this printing method yields improved print speeds but no longer allows for multi-pass printing. Therefore, a method to verify that a nozzle is jetting properly is needed.

One such method is by optical detection as disclosed in U.S. Pat. Nos. 8,177,318, 8,376,506 and 8,449,068, as well as others. This method requires external light sources and sensors which can add cost and complexity to the printing device.

In an effort to eliminate the need for external devices, other methods have been disclosed which place impedance sensors on the ejector chip itself. One possible implementation of this method is described in U.S. Pat. Nos. 8,870,322, 8,899,709 and US Patent Application Publication No. 2014/0333694. These patents and applications teach the use of either differential or single ended impedance measurements taken over time to detect the formation and collapse of thermal vapor bubbles. It is further taught that different types of nozzle conditions such as blocked or weak nozzles can be determined by external processing of the data collected from the sensors. As disclosed particularly in U.S. Pat. No. 8,870,322, a method of calibration may be required to provide adequate performance of the system.

All of the prior attempts at determining condition of a printhead are based on detecting the formation of a bubble in an ink chamber. One shortcoming of this method is that by the time the bubble has reached the sensors the ejection event has passed. In most cases the detection of the bubble in the throat and chamber will occur 5 μs or more after the drop has been ejected.

SUMMARY OF THE INVENTION

An object of the present invention is to provide a system and method for detecting the formation of a bubble on a heater surface based on the change in electrical resistance of the heater.

Another object of the present invention is to provide a system and method for detecting the formation of a bubble on a heater surface based on the change in slope of the sampled drain voltage of a corresponding drive element.

A fluid printhead according to an exemplary embodiment of the present invention comprises: a plurality of heater elements that are driven to nucleate bubbles in fluid so that the fluid is ejected from the printhead in the form of drops; a plurality of drive elements, each drive element selectively driving a corresponding one of the plurality of heater elements in accordance with a printer controller; and a drop detection system comprising a plurality of drop detection cells, each drop detection cell detecting a change in electrical resistance of a corresponding one of the plurality of heater elements that occurs upon drop formation.

In an exemplary embodiment, each of the plurality of drive elements is a MOSFET drive element comprising a gate, a source and a drain.

In an exemplary embodiment, each drop detection cell is electrically connected to the drain of a corresponding drive element.

In an exemplary embodiment, each drop detection cell detects a voltage slope change at the drain of the corresponding drive element.

In an exemplary embodiment, each drop detection cell comprises a controller configured to remove power from the corresponding heater element after detection of the voltage slope change.

In an exemplary embodiment, each drop detection cell comprises a sampling circuit and a slope detect circuit.

In an exemplary embodiment, the sampling circuit comprises a switched capacitor circuit.

In an exemplary embodiment, the sampling circuit comprises an A/D circuit.

According to an exemplary embodiment of the present invention, a method of controlling operation of a plurality of drive elements of a printhead, where each drive element selectively drives a corresponding one of the plurality of heater elements to nucleate bubbles in fluid so that the fluid is ejected from the printhead in the form of drops, comprises: detecting a change in electrical resistance of a corresponding one of the plurality of heater elements that occurs upon drop formation; and deactivating the corresponding one of the plurality of heater elements based on the detection.

In an exemplary embodiment, each of the plurality of drive elements is a MOSFET drive element comprising a gate, a source and a drain, and the step of detecting comprises detecting a voltage slope change at the drain of the corresponding drive element.

Other features and advantages of embodiments of the invention will become readily apparent from the following detailed description, the accompanying drawings and the appended claims.

BRIEF DESCRIPTION OF THE DRAWINGS

The features and advantages of exemplary embodiments of the present invention will be more fully understood with reference to the following, detailed description when taken in conjunction with the accompanying figures, wherein.

DETAILED DESCRIPTION

Figure 1:
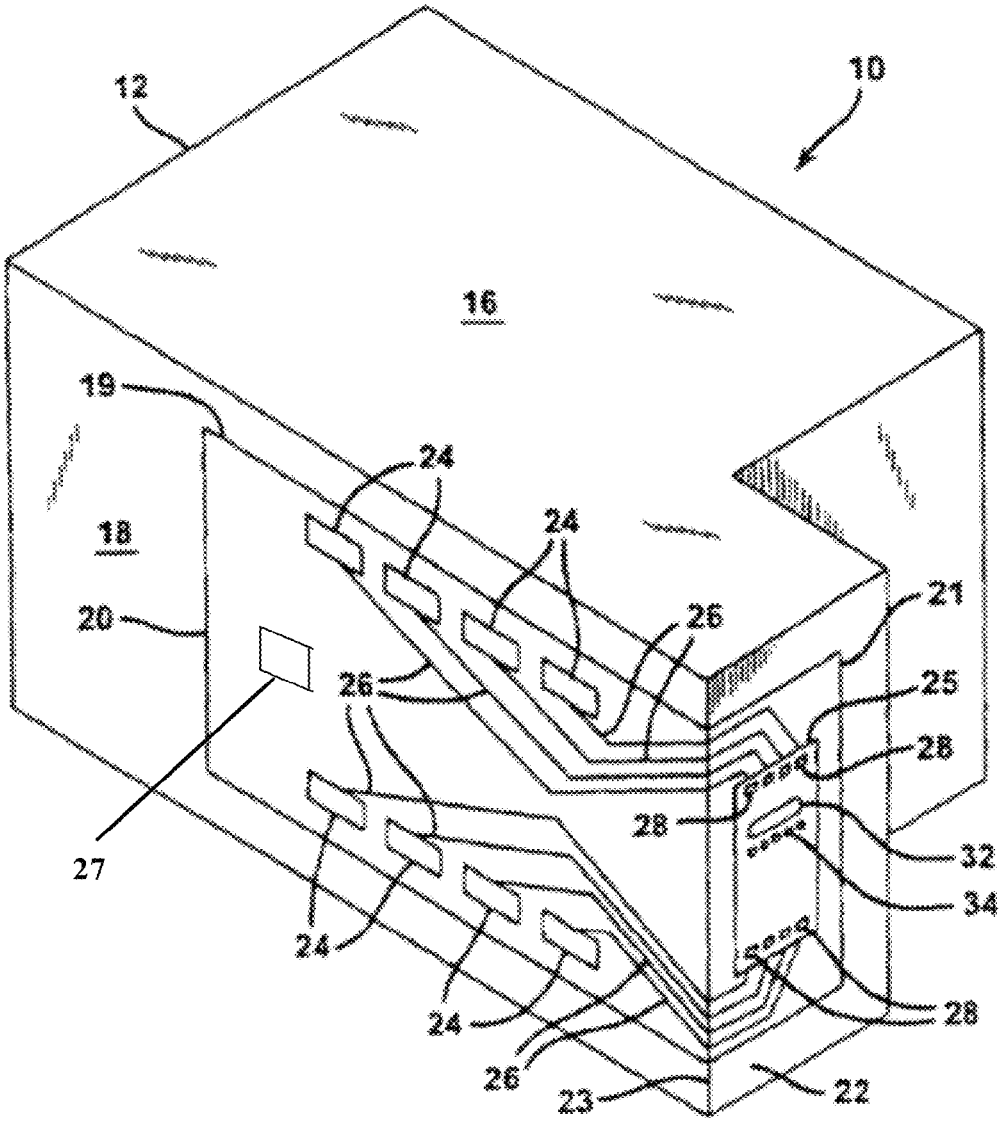
FIG. 1 is a perspective view of an inkjet printhead according to an exemplary embodiment of the present invention.

The headings used herein are for organizational purposes only and are not meant to be used to limit the scope of the description or the claims. As used throughout this application, the words "may" and "can" are used in a permissive sense (i.e., meaning having the potential to), rather than the mandatory sense (i.e., meaning must). Similarly, the words "include," "including," and "includes" mean including but not limited to. To facilitate understanding, like reference numerals have been used, where possible, to designate like elements common to the figures.

With reference to FIG. 1, an inkjet printhead according to an exemplary embodiment of the present invention is shown generally as 10. The printhead 10 has a housing 12 formed of any suitable material for holding ink. Its shape can vary and often depends upon the external device that carries or contains the printhead. The housing has at least one compartment 16 internal thereto for holding an initial or refillable supply of ink. In one embodiment, the compartment has a single chamber and holds a supply of black ink, photo ink, cyan ink, magenta ink or yellow ink. In other embodiments, the compartment has multiple chambers and contains three supplies of ink. Preferably, it includes cyan, magenta and yellow ink. In still other embodiments, the compartment contains plurals of black, photo, cyan, magenta or yellow ink. It will be appreciated, however, that while the compartment 16 is shown as locally integrated within a housing 12 of the printhead, it may alternatively connect to a remote source of ink and receive supply from a tube, for example.

Adhered to one surface 18 of the housing 12 is a portion 19 of a flexible circuit, especially a tape automated bond (TAB) circuit 20. The other portion 21 of the TAB circuit 20 is adhered to another surface 22 of the housing. In this embodiment, the two surfaces 18, 22 are perpendicularly arranged to one another about an edge 23 of the housing.

The TAB circuit 20 supports a plurality of input/output (I/O) connectors 24 thereon for electrically connecting a heater chip 25 to an external device, such as a printer, fax machine, copier, photo-printer, plotter, all-in-one, etc., during use. Pluralities of electrical conductors 26 exist on the TAB circuit 20 to electrically connect and short the I/O connectors 24 to the input terminals (bond pads 28) of the heater chip 25. Those skilled in the art know various techniques for facilitating such connections. For simplicity, FIG. 1 only shows eight I/O connectors 24, eight electrical conductors 26 and eight bond pads 28 but present day printheads have much larger quantities and any number is equally embraced herein. Still further, those skilled in the art should appreciate that while such number of connectors, conductors and bond pads equal one another, actual printheads may have unequal numbers.

The heater chip 25 contains a column 34 of a plurality of fluid firing elements that serve to eject ink from compartment 16 during use. The fluid firing elements may embody thermally resistive heater elements (heaters for short) formed as thin film layers on a silicon substrate or piezoelectric elements despite the thermal technology implication derived from the name heater chip. For simplicity, the pluralities of fluid firing elements in column 34 are shown adjacent an ink via 32 as a row of five dots but in practice may include several hundred or thousand fluid firing elements. As described below, vertically adjacent ones of the fluid firing elements may or may not have a lateral spacing gap or stagger there between. In general, the fluid firing elements have vertical pitch spacing comparable to the dots-per-inch resolution of an attendant printer. Some examples include spacing of 1/300th, 1/600th, 1/1200th, 1/2400th or other of an inch along the longitudinal extent of the via. To form the vias, many processes are known that cut or etch the via 32 through a thickness of the heater chip. Some of the more preferred processes include grit blasting or etching, such as wet, dry, reactive-ion-etching, deep reactive-ion-etching, or other. A nozzle plate (not shown) has orifices thereof aligned with each of the heaters to project the ink during use. The nozzle plate may attach with an adhesive or epoxy or may be fabricated as a thin-film layer.

A memory unit 27 stores data related to information such as, for example, the production date, the lifetime and the number of refilled times that can be made.

Figure 2:
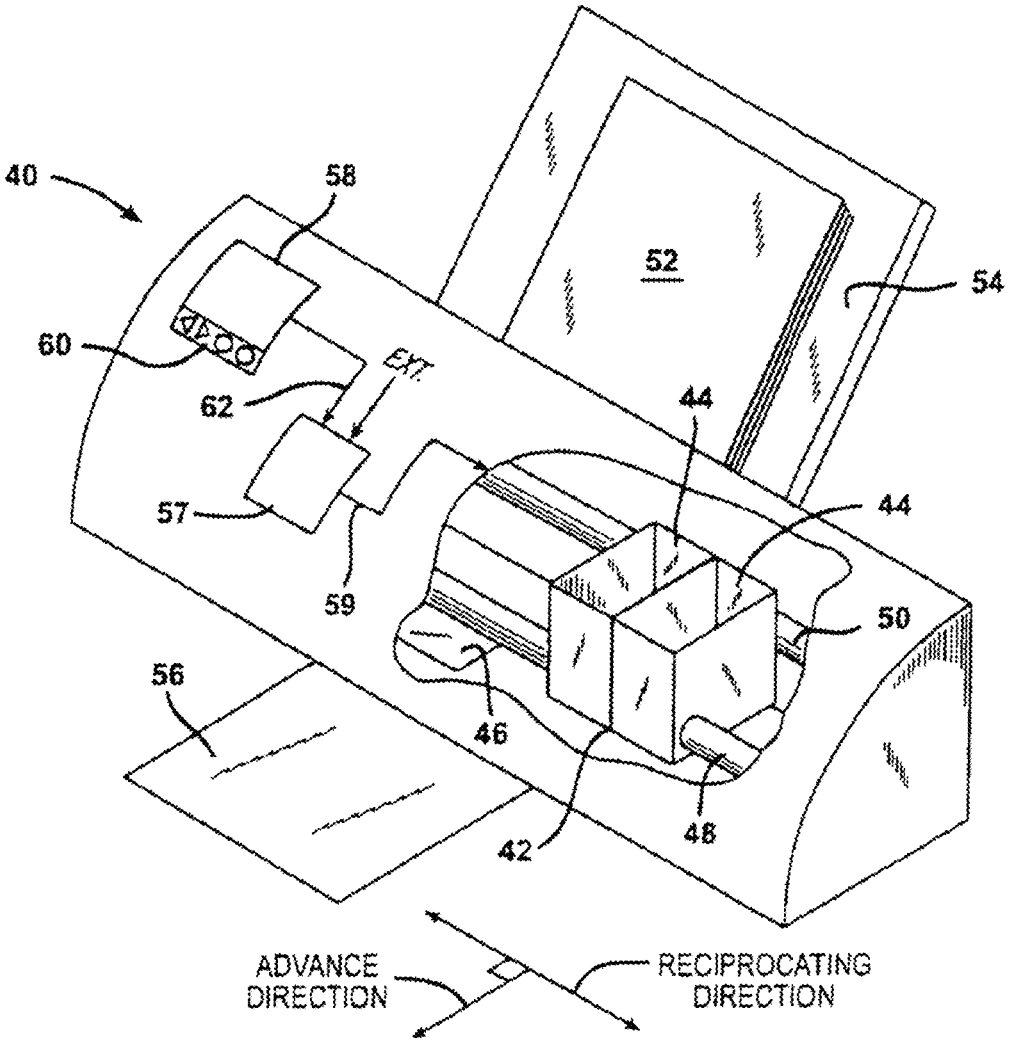
FIG. 2 is a perspective view of an inkjet printer according to an exemplary embodiment of the present invention.

With reference to FIG. 2, an external device in the form of an inkjet printer for containing the printhead 10 is shown generally as 40. The printer 40 includes a carriage 42 having a plurality of slots 44 for containing one or more printheads 10. The carriage 42 reciprocates (in accordance with an output 59 of a controller 57) along a shaft 48 above a print zone 46 by a motive force supplied to a drive belt 50 as is well known in the art. The reciprocation of the carriage 42 occurs relative to a print medium, such as a sheet of paper 52 that advances in the printer 40 along a paper path from an input tray 54, through the print zone 46, to an output tray 56.

While in the print zone, the carriage 42 reciprocates in the Reciprocating Direction generally perpendicularly to the paper 52 being advanced in the Advance Direction as shown by the arrows. Ink drops from compartment 16 (FIG. 1) are caused to be eject from the heater chip 25 at such times pursuant to commands of a printer microprocessor or other controller 57. The timing of the ink drop emissions corresponds to a pattern of pixels of the image being printed. Often times, such patterns become generated in devices electrically connected to the controller 57 (via Ext. input) that reside externally to the printer and include, but are not limited to, a computer, a scanner, a camera, a visual display unit, a personal data assistant, or other.

To print or emit a single drop of ink, the fluid firing elements (the dots of column 34, FIG. 1) are uniquely addressed with a small amount of current to rapidly heat a small volume of ink. This causes the ink to vaporize in a local ink chamber between the heater and the nozzle plate and eject through, and become projected by, the nozzle plate towards the print medium. The fire pulse required to emit such ink drop may embody a single or a split firing pulse and is received at the heater chip on an input terminal (e.g., bond pad 28) from connections between the bond pad 28, the electrical conductors 26, the I/O connectors 24 and controller 57. Internal heater chip wiring conveys the fire pulse from the input terminal to one or many of the fluid firing elements.

A control panel 58, having user selection interface 60, also accompanies many printers as an input 62 to the controller 57 to provide additional printer capabilities and robustness.

Figure 3:
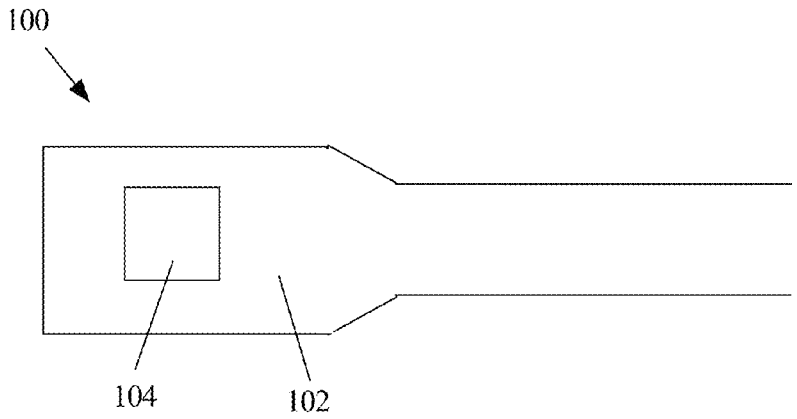
FIG. 3 is a planar view of a fluid ejection element according to an exemplary embodiment of the present invention.

FIG. 3 is a planar view of a fluid ejection element, generally designated by reference number 100, according to an exemplary embodiment of the present invention. The fluid ejection element 100 includes a fluid chamber 102 formed using photolithographic methods to image and develop the feature in a photosensitive material. The chamber 102 may have a thickness of about 15 um. A thin film heating element 104 is located within the chamber 102. The heating element 104 can be energized by applying a voltage potential across the device. In a typical inkjet application, the temperature at the surface of the heating element will increase from ambient to about 350° C. in less than 1 μs. In the case where the chamber is filled with an aqueous ink solution, a vapor bubble will form at the surface of the heating element and then quickly expand. It is this expansion which forces ink out of the chamber through a nozzle orifice. Typically a nozzle (not shown in FIG. 3) is located above the heating element 104. The dimensions of the heating element 104 is highly dependent on the drop size and characteristics of the liquid to be ejected, but in general the aspect ratio (Length/Width) of the element is usually between 1 and 3. In an exemplary embodiment, the heating element 104 is formed by depositing a thin layer, about 800 A, of TaAlN.

After ink or other fluid is ejected from the chamber 102 through the nozzle opening the vapor bubble will collapse. The collapse of the bubble exerts a significant cavitation force which would quickly destroy the heating element 104. It is for that reason that a cavitation protection layer is applied about the heating element 104. In an exemplary embodiment, the cavitation protection layer is made of tantalum. While tantalum is typically used because of material hardness and chemical resistance, other materials could be used as well.

In exemplary embodiments of the present invention, the formation of a bubble on a heater surface is detected based on the slope change in the current passing through the heater. At the time the liquid leaves the chamber, the heater is functioning in essentially a dry state. It is during this time that the heater surface will experience an increase in the rate at which it is heating. By detecting this change in heating, the exact moment of bubble formation can be detected.

Figure 4:
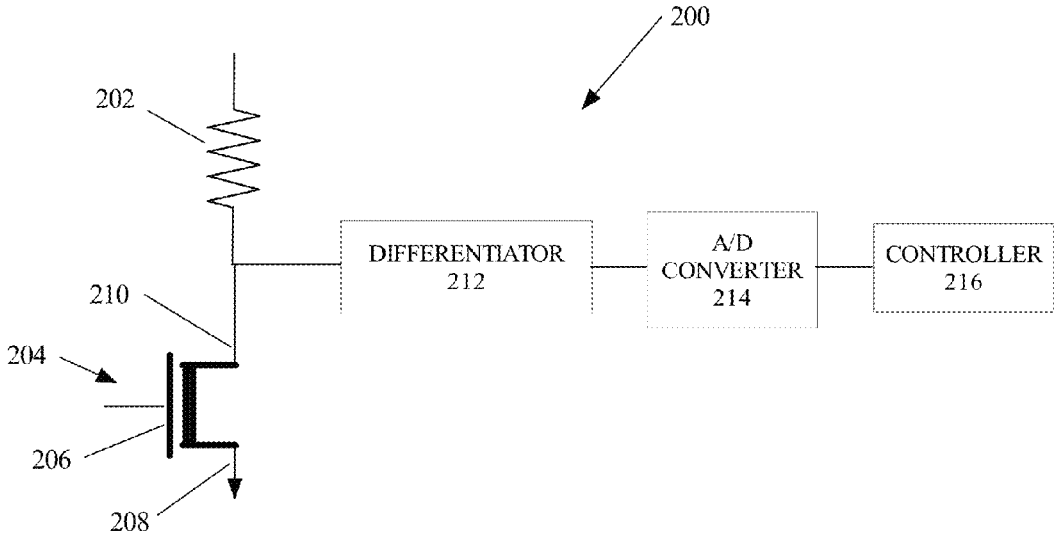
FIG. 4 is a block diagram of one cell of a drop detection system according to an exemplary embodiment of the present invention.

FIG. 4 is a block diagram of one cell, generally designated by reference number 200, of a drop detection system according an exemplary embodiment of the present invention. The cell 200 includes a differentiator 212, and A/D converter 214 and a controller 216. The cell 200 is configured to sense the voltage at the drain of the power FET of the driving element of each heater. Thus, the number of cells in the overall detection system depends on the number of heaters on the printhead chip. Alternatively, the drop detection system may have a bus architecture so that all the drain voltages can be sent to a common differentiator and controller. In FIG. 4, a heater 202 is shown (represented as a resistor) including a corresponding driving element 204. The driving element 204 is preferably a MOSFET driving element, including a polysilicon gate 206, source 208, and drain 210. As known in the art, each driving element is operable to selectively enable the heaters according to a logic structure provided by a printer controller.

Figure 5:
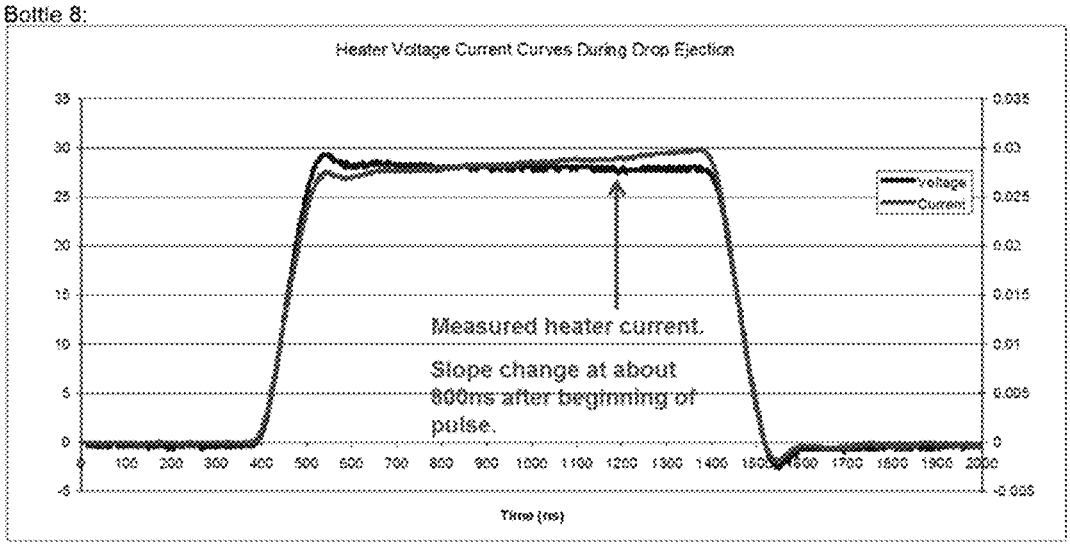
FIG. 5 is a chart of voltage and current vs. time for a heater during the formation of a bubble and subsequent ejection of the liquid drop.
Figure 6:
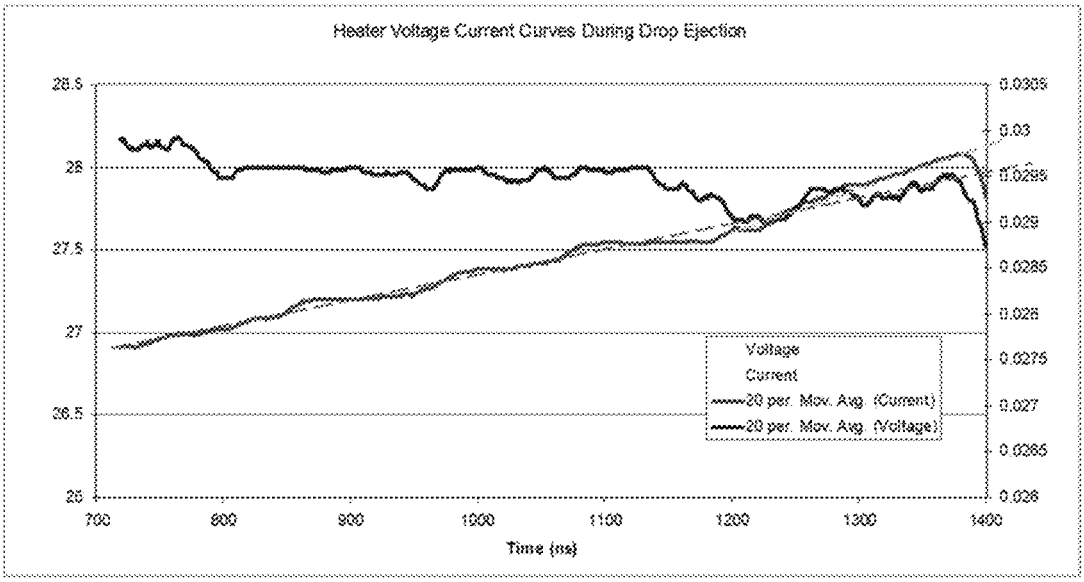
FIG. 6 is a closer view of the chart shown in FIG. 5.
Figure 7:
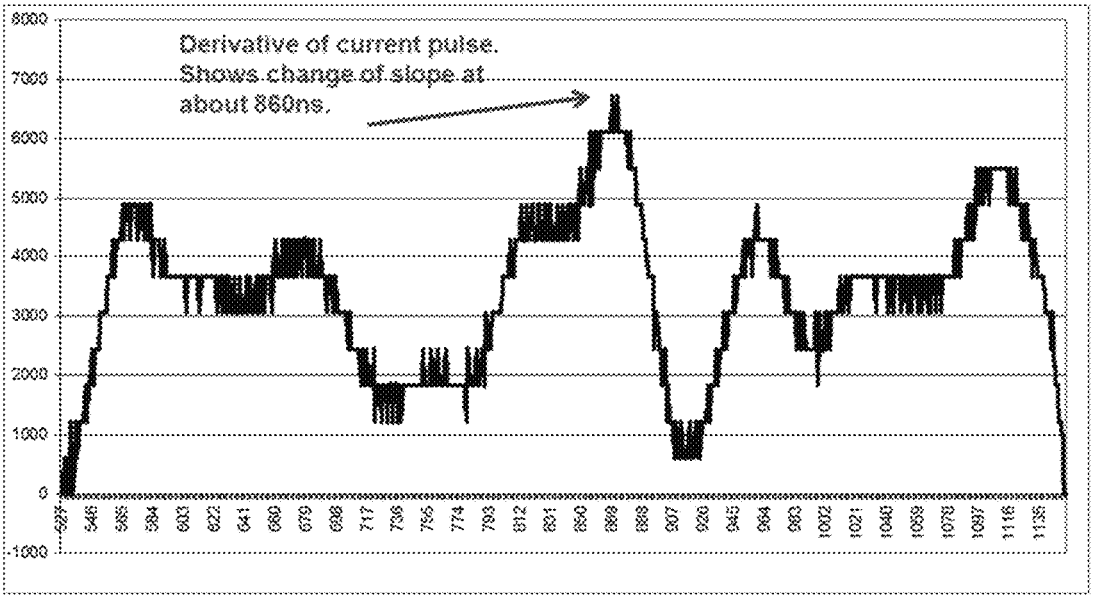
FIG. 7 is a chart showing the output of a differentiation operation performed on the current level change shown in FIG. 5.

The differentiator 212 is electrically connected to the drain 210 of the driving element 204. The differentiator 212 serves to enhance the small slope change of the voltage that occurs at the time of drop formation. In this regard, FIG. 5 shows the current through a heater during the formation of a bubble and subsequent ejection of the liquid drop. In the example shown, the heater material has a sheet resistance of 350 ohms/sqr. and a negative temperature coefficient of −320 ppm. As shown at the time of drop formation, at about 800 ns, there is a slight increase in the slope of the heater current. This is better illustrated in FIG. 6, where the same event is showed but at a larger magnification zoomed to the time of ejection. While the slope change is small it is detectable. FIG. 7 shows the output after applying a differentiation operation to the signal on the measuring oscilloscope, and in particular shows change of slope of the heater current at about 860 ns.

In exemplary embodiment, the detection system senses the current through the heater circuit in order to sense nucleation. However, according to a preferred embodiment, the voltage at the drain of the power FET is sensed. As with the measured current previously discussed, the slope change of the voltage is small and is best enhanced by a differentiation of the value by the differentiator 212. The differentiator 212 may be any suitable differentiator circuit known in the art and may include circuit components such as, for example, capacitors and operational amplifiers.

The output of the differentiator 212 is sent to the A/D converter 214, the output of which is then sent to the controller 216. The controller 216 may be configured to remove power from the heater 202 after drop formation has been detected. In this way, the cell 200 may be used to determine the condition of the heater. For example, by programming the controller with preset values for voltage slope change and times, the cell 200 can determine whether a voltage slope change actually occurs, and if so, whether the slope change matches the programmed value and timing. Any deviation from the programmed values would indicate that the heater is not operating normally.

The controller 216 may be configured to disable the fire pulse when the ejection of a drop is detected. In this regard, when a slope change is detected, the differentiator 212 may output a logic high or digital 1. When this value is inverted and then ANDed with the fire pulse the result is that the signal is gated and the power FET device is turned off.

Figure 8A:
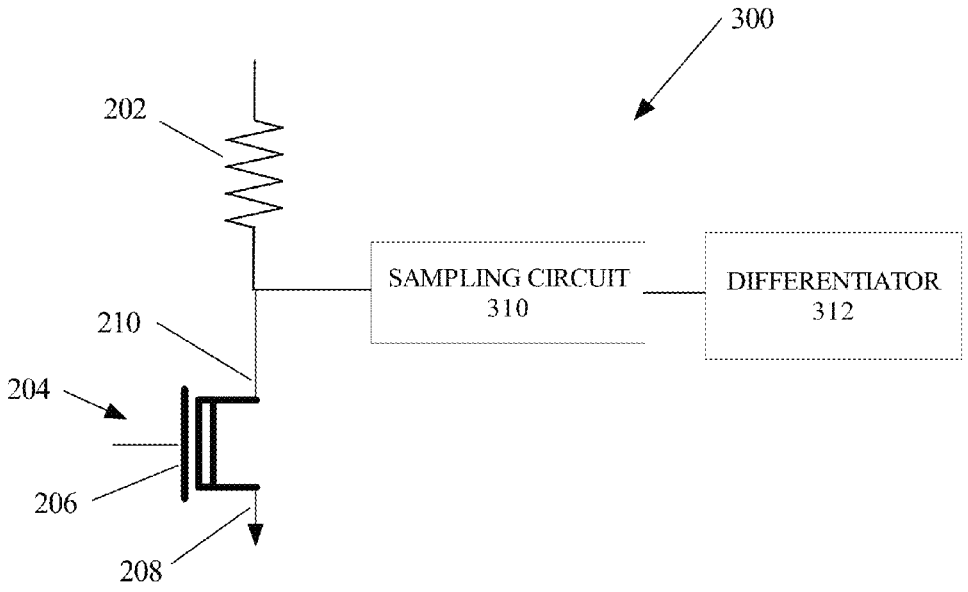
FIG. 8A a block diagram of one cell of a drop detection system according to an exemplary embodiment of the present invention in a steady state.
Figure 8B:
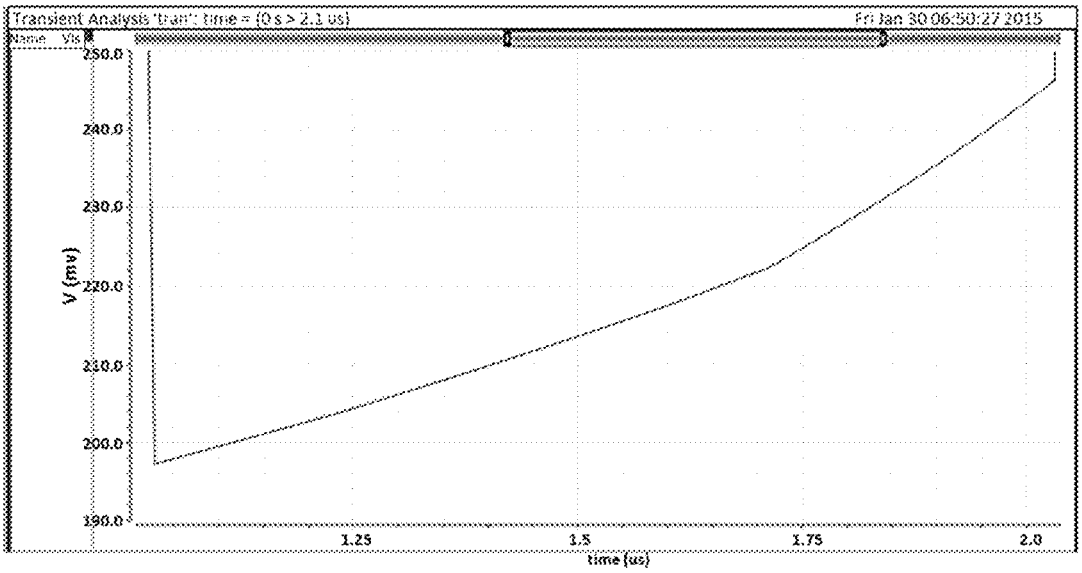
FIG. 8B is chart showing the drain voltage input to a sampling circuit according to an exemplary embodiment of the present invention.
Figure 8C:
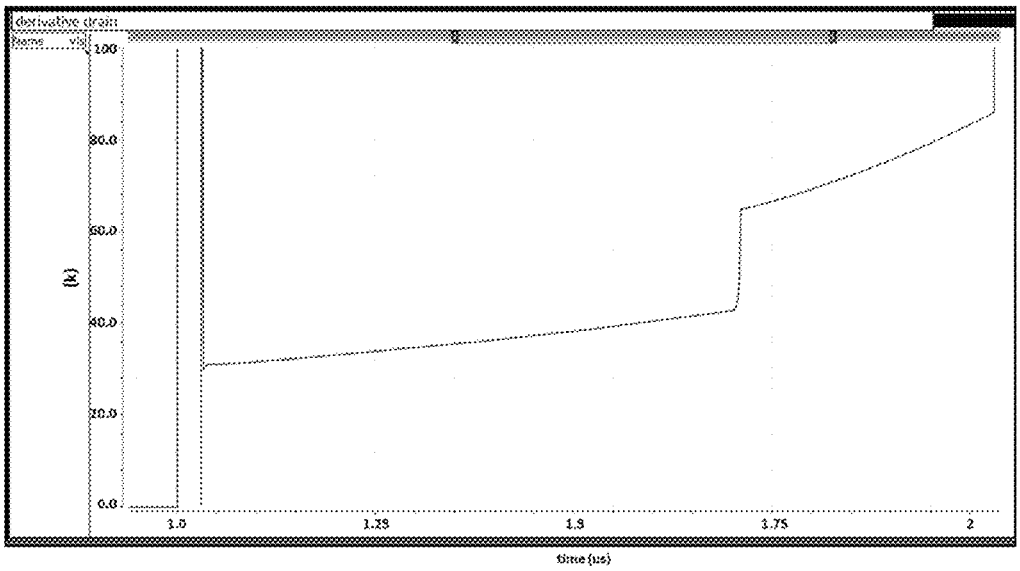
FIG. 8C is chart showing the differentiation operation performed by a slope detect circuit according to an exemplary embodiment of the present invention.
Figure 8D:
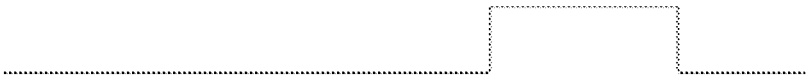
FIG. 8D shows the digital output of a slope detect circuit according to an exemplary embodiment of the present invention.

FIG. 8A is a block diagram of one cell, generally designated by reference number 300, of a drop detection system according another exemplary embodiment of the present invention. The cell 300 includes a sampling circuit 310 and a slop detect circuit 312. As shown, the voltage is sampled at the transistor drain node as described in regards to the previous embodiment, but in the present embodiment the drain voltage is passed to the sampling circuit 310. FIG. 8B shows the drain voltage acting as an input to the sampling circuit 310. The sampling circuit 310 can be a switched capacitor circuit with an analog output or an A/D circuit with a digital output. This value is fed into the slope detect circuit 312 which performs a sample to sample differentiation of the signal. The result of the sample to sample differentiation is shown in FIG. 8C. The sudden change in slope is detected within the slope detect circuit 312 and converted to a digital output as shown in FIG. 8D. As in the previous embodiment, the slope detect circuit differentiator 312 may output a logic high or digital 1 which is used to turn the power MOS FET off.

While particular embodiments of the invention have been illustrated and described, it would be obvious to those skilled in the art that various other changes and modifications may be made without departing from the spirit and scope of the invention. It is therefore intended to cover in the appended claims all such changes and modifications that are within the scope of this invention.

What is claimed is:

1. A fluid printhead, comprising:

a plurality of heater elements that are driven to nucleate bubbles in fluid so that the fluid is ejected from the printhead in the form of drops;

a plurality of drive elements, each drive element selectively driving a corresponding one of the plurality of heater elements in accordance with a printer controller; and a drop detection system comprising a plurality of drop detection cells, each drop detection cell detecting a change in electrical resistance of a corresponding one of the plurality of heater elements that occurs upon drop formation.

2. The fluid printhead of claim 1, wherein each of the plurality of drive elements is a MOSFET drive element comprising a gate, a source and a drain.

3. The fluid printhead of claim 2, wherein each drop detection cell is electrically connected to the drain of a corresponding drive element.

4. The fluid printhead of claim 3, wherein each drop detection cell detects a voltage slope change at the drain of the corresponding drive element.

5. The fluid printhead of claim 4, wherein each drop detection cell comprises a controller configured to remove power from the corresponding heater element after detection of the voltage slope change.

6. The fluid printhead of claim 1, wherein each drop detection cell comprises a sampling circuit and a slope detect circuit.

7. The fluid printhead of claim 6, wherein the sampling circuit comprises a switched capacitor circuit.

8. The fluid printhead of claim 6, wherein the sampling circuit comprises an A/D circuit.

9. A method of controlling operation of a plurality of drive elements of a printhead, each drive element selectively driving a corresponding one of the plurality of heater elements to nucleate bubbles in fluid so that the fluid is ejected from the printhead in the form of drops, comprising:

detecting a change in electrical resistance of a corresponding one of the plurality of heater elements that occurs upon drop formation; and deactivating the corresponding one of the plurality of heater elements based on the detection.

10. The method of claim 9, wherein each of the plurality of drive elements is a MOSFET drive element comprising a gate, a source and a drain, and the step of detecting comprises detecting a voltage slope change at the drain of the corresponding drive element.

* * * * *